US007866522B2

(12) United States Patent
Chen et al.

(10) Patent No.: US 7,866,522 B2
(45) Date of Patent: Jan. 11, 2011

(54) STAPLING DEVICE

(75) Inventors: Ton-Yi Chen, Taichung (TW); Yuan-Shun Lee, Taichung (TW)

(73) Assignee: Jann Yei Industry Co., Ltd., Taichung (TW)

( * ) Notice: Subject to any disclaimer, the term of this patent is extended or adjusted under 35 U.S.C. 154(b) by 72 days.

(21) Appl. No.: 12/469,700

(22) Filed: May 21, 2009

(65) Prior Publication Data

US 2010/0089964 A1 Apr. 15, 2010

(30) Foreign Application Priority Data

Oct. 14, 2008 (TW) ..... 97139437 A

(51) Int. Cl.
*B25C 5/00* (2006.01)

(52) U.S. Cl. ..... 227/120; 227/134; 227/119

(58) Field of Classification Search ..... 227/120, 227/134, 119

See application file for complete search history.

(56) References Cited

U.S. PATENT DOCUMENTS

| | | | | |
|---|---|---|---|---|
| 3,758,016 | A * | 9/1973 | Olney et al. | 227/132 |
| 4,025,031 | A * | 5/1977 | Chi | 227/132 |
| 4,113,164 | A * | 9/1978 | Muthenthaller | 227/124 |
| 2006/0071047 | A1 * | 4/2006 | Aguirre et al. | 227/119 |
| 2006/0231582 | A1 * | 10/2006 | Hong et al. | 227/109 |

* cited by examiner

*Primary Examiner*—Brian D Nash
(74) *Attorney, Agent, or Firm*—Leong C. Lei

(57) ABSTRACT

Disclosed in a stapling device that is sound, safe, convenient and not easy to get lost and that is applicable to staples of multiple specifications. A casing has a rear end to which an adjustor is set. The adjustor has a fitting portion that is comprised of two or more than two fitting blocks each having an engaging face that is spaced from a central axis of the adjustor by a different distance. A rear end of the casing is provided with a depress-to-fix member corresponding to the adjustor. The depress-to-fix member forms a fitting slot. This arrangement allows selective change engagement between the fitting slot and different fitting blocks thereby changing the set position of a rear guide plate and realizing change of gap size of a staple outlet opening for being applicable to staples of different specifications.

23 Claims, 10 Drawing Sheets

STAPLING DEVICE

TECHNICAL FIELD OF THE INVENTION

The present invention generally relates to as stapling device, and in particular to a stapling device that is readily and safety applicable to staples of different wire gauges.

DESCRIPTION OF THE PRIOR ART

In order to use staples of different wire gauges in a stapling device, the stapling device must be structured in such a way to change a gap size or width of a staple outlet opening. An example is shown in FIG. 1, wherein a stapling device has a casing 10 that is formed by mating two opposing casing members and has opposite end portions respectively forming a staple ejection portion 101 and a magazine access portion 102. The staple ejection portion 101 movably receives therein a staple striker plate 11. The casing 30 has a lower portion forming a receiving seat 12 that slidably receives a staple magazine 20 therein and has a rear end forming a retention hole 120 and a front end having opposite inner faces respectively forming a front retention block 131 and a rear retention block 132, which are spaced from a front edge of the receiving seat 12 by different distances. A front guide plate 15 has a first end 151 and a second end 152 and forms first and second extensions that respectively project from intermediate sections of opposite walls. Upper and lower edges of the first extension 161 respectively form a first front notch 171 and a second rear notch 182, and the second extension 162 forms, in upper and lower edges thereof, a second front notch 181 and a first rear notch 172. The staple magazine 20 is slidably received into the receiving seat 12 through the magazine access portion 102 and has a front end forming a rear guide plate 21 that is substantially parallel to the front guide plate 15. The front and rear guide plats 15, 21 form therebetween staple outlet openings A, B (see FIGS. 2 and 3) for ejecting staples. The staple magazine 20 has a staple pusher 22 arranged thereon and has a rear end to which a depress-to-fix member 45 that can automatically effect upward position returning is rotatably mounted to. The depress-to-fix member 25 forms a fitting block 250, which is engageable with the retention slot 120 when the staple magazine 20 slides into the receiving seat 12 so as allow the staple magazine 20 to be set in the receiving seat 12 and also allow the staple magazine 20 to be withdrawn by depressing the depress-to-fix member 25 to disengage the fitting block 250 from the retention slot 120.

In operation, as shown in FIGS. 2 and 3, the front guide plate 15 is rotated in accordance with the staple wire gauge of the staples used to have first front notch 171 and the first rear notch 172, or the second front notch 181 and the second rear notch 182, engaging the front and rear retention blocks 131, 123, pointing the first end 151 or the second end 152 downward. Since the first front and rear notches 171, 172 and the second front and rear notches 181, 182 are spaced from the front edge of the front guide plate 15 by different distances, the gap size or width of the first and second ends 151, 152 with respect to the rear guide plate 21 can be selectively set to a first staple outlet opening A (see FIG. 2) that is relatively narrow and is applicable to staples of a small wire gauge or a second staple outlet opening B (see FIG. 3) that is relatively wide and is applicable to staples of a great wire.

The operation of setting gap size of width of the staple outlet opening is realized through the front guide plate 15 that is selectively set in engagement with or disengaging from the receiving seat 12 and the engagement is primarily done by means of the first front and rear notches 171, 172 and the second front and rear notches 181, 182. However, since the front guide plate 15 is arranged in the staple ejection portion 101, within which the staple striker plate 11 that effects powerful downward striking is received. This arrangement is based on the front and rear retention blocks 131, 132 to relatively fix the front guide plate 15, which is susceptible to loosening and results in instability. Thus, the first front and rear notches 171, 172 and the first and second notches 182, 182 must be tightly fit with the front and rear retention blocks 131, 132 to prevent the front guide plate 15 from getting loosened in the operation of stapling. This, however, makes it difficult to release and re-orient the front guide plate, leading to inconvenience of operation. Further, after a long term of operation, the front plate 15 may still get loosened due to the successive and powerful striking of the staples and this may lead to potential risk. Further, the front guide plate 15 may get lost when it is stored. This causes troubles to the user. Further, the conventional stapling device is only applicable to staples of two different staple wire gauges; this stands for a limitation to the application of the stapling device. Conclusively, the conventional stapling device may be further improved in the respects of structural stability, operation convenience, safety of staple striking, loss of parts, and universal capability for multiple specifications.

SUMMARY OF THE INVENTION

The primary objective of the present inventor is to provide a stapling device that is applicable to staples of different wire gauges and features soundness, safety, and being not easy to get lost to thereby enhance the convenience thereof and ensure structural stability for improving the operation safety and not easy to get lost for the stapling device.

The present invention provides a stapling device that is universally applicable to staples of multiple staple wire gauges to allow a user to use a single stapling device to handle staples of multiple wire gauges and thus enhancing operation convenience.

The present invention provide a stapling device that comprises an adjustor to change the position of a staple magazine in a front-rear direction thereby changing the opening size of a staple outlet opening defined between front and rear guide plates, whereby the operation is made easy, structural soundness and safety are improved, detachment and loss of parts can be avoided, and the variability of the opening size of staple outlet is enhanced. Thus, the added value of the stapling device is increased and the economic value is also improved.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
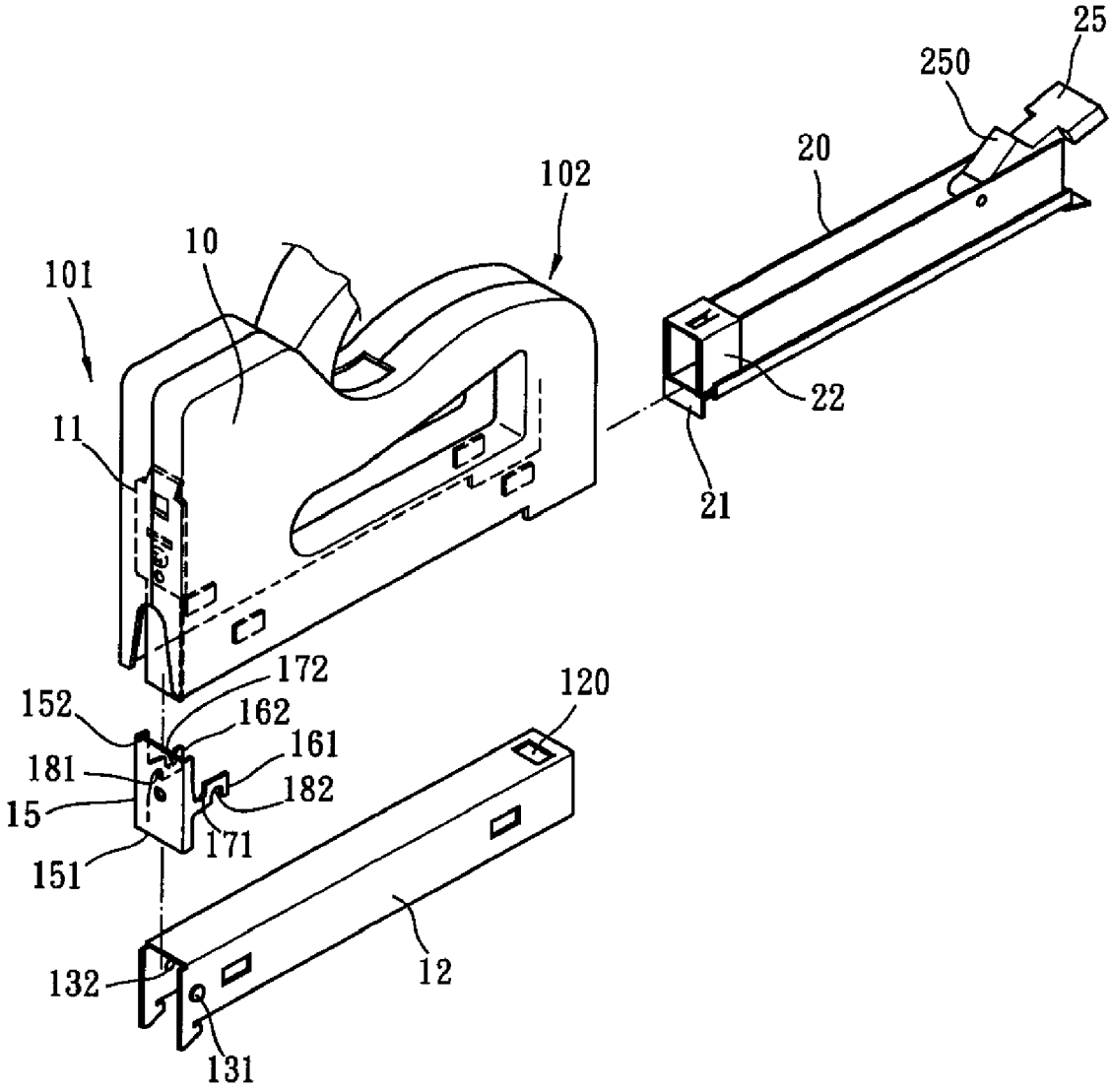
FIG. 1 is an exploded view of a conventional stapling device.
Figure 2:
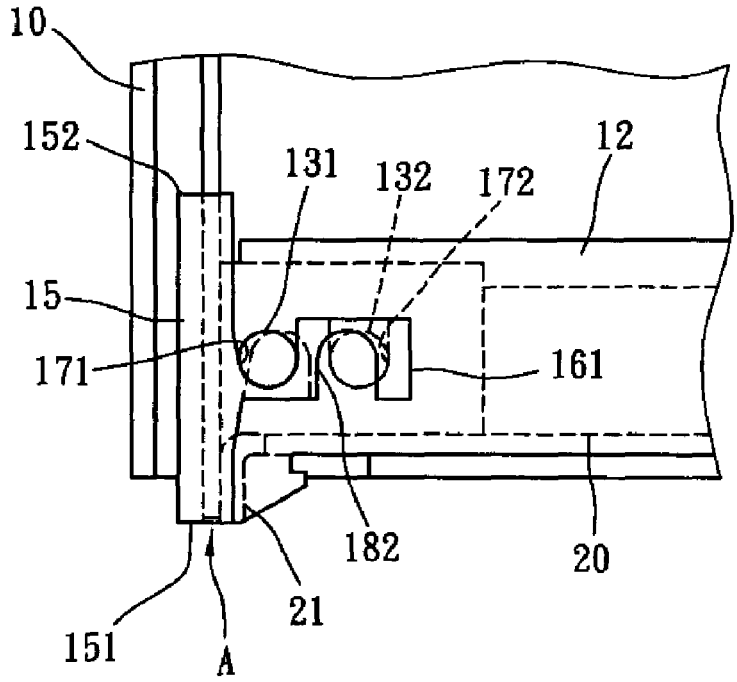
FIG. 2 is a partial cross-sectional view illustrating the operation of the conventional stapling device with staples of small wire gauge.
Figure 3:
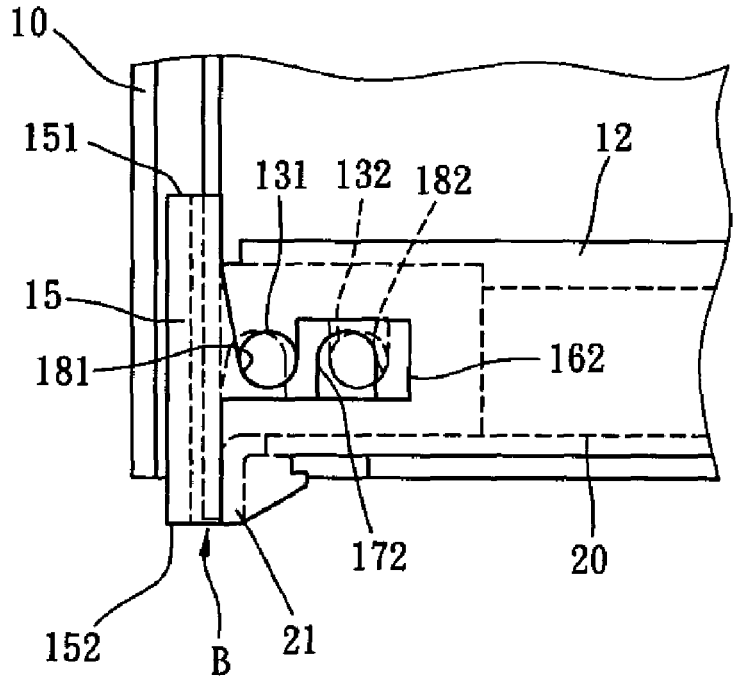
FIG. 3 is a partial cross-sectional view illustrating the operation of the conventional stapling device with staples of large gauge.
Figure 4:
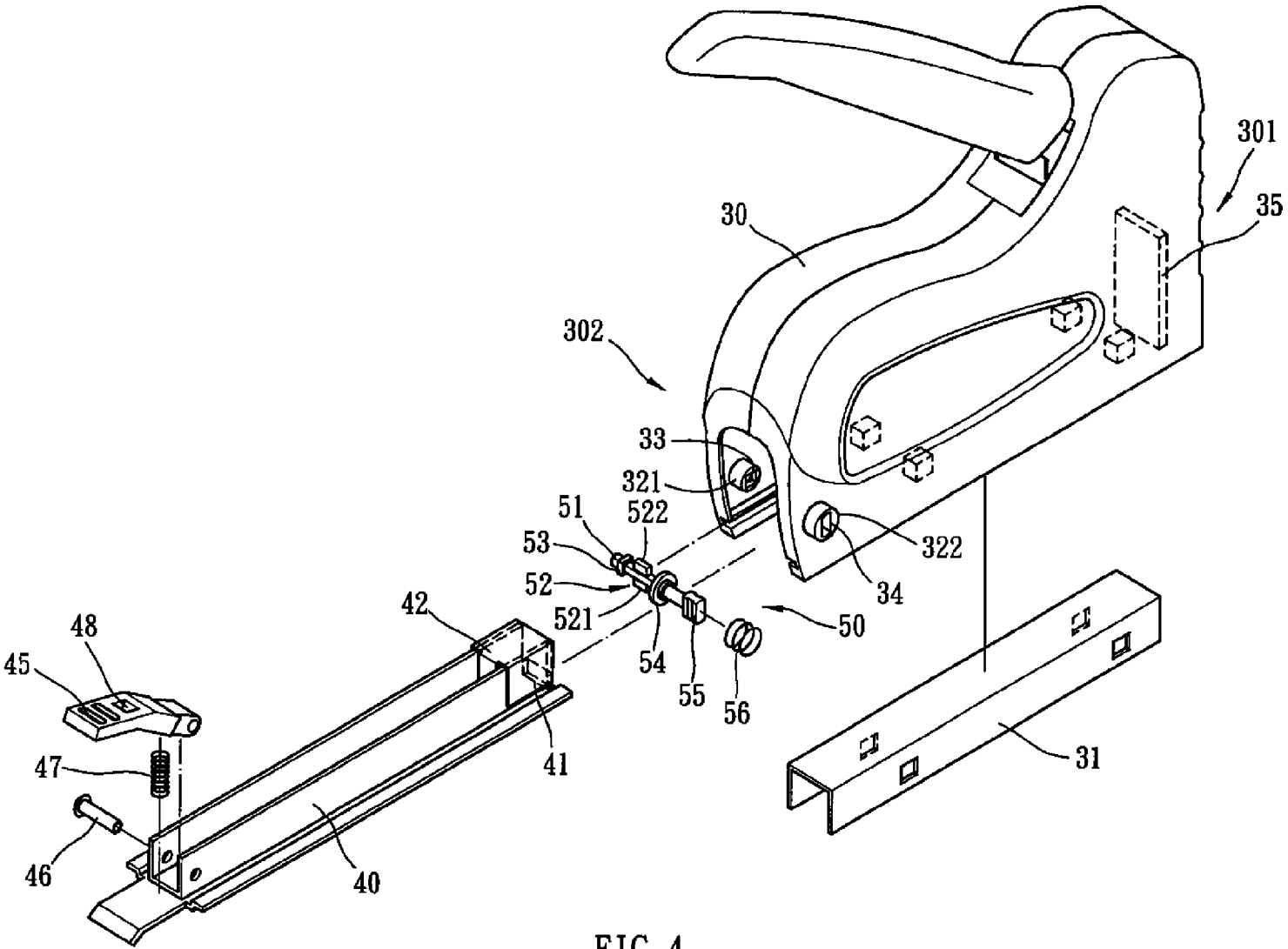
FIG. 4 is an exploded view of a stapling device constructed in accordance with a first embodiment of the present invention.
Figure 5:
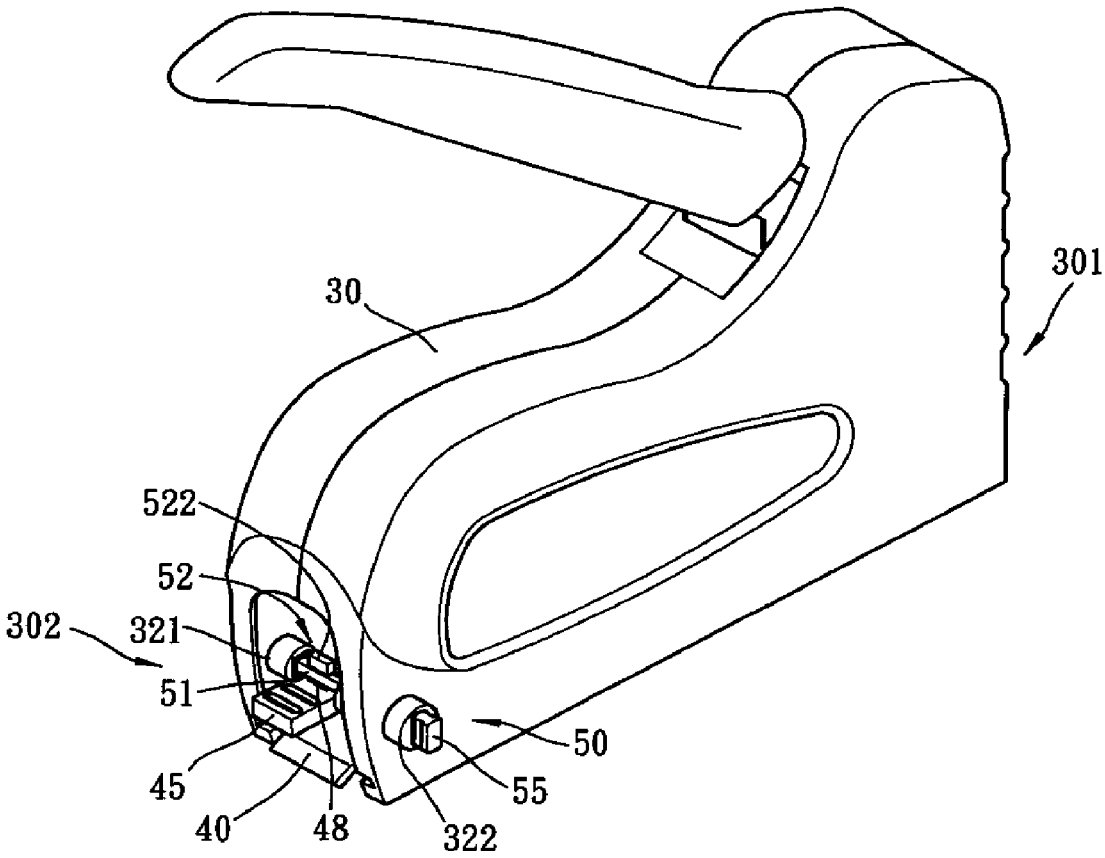
FIG. 5 is a perspective view of the stapling device of the first embodiment of the present invention.
Figure 6:
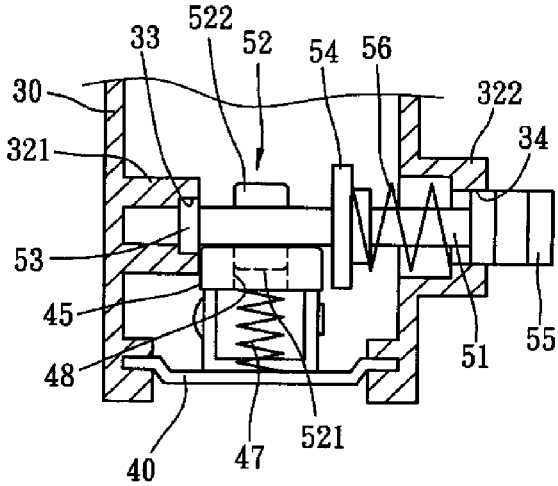
FIG. 6 is a cross-sectional view of the stapling device of the first embodiment of the present invention, observed from the rear side, illustrating the spatial arrangement of an adjustor and depress-to-fix member thereof.
Figure 7:
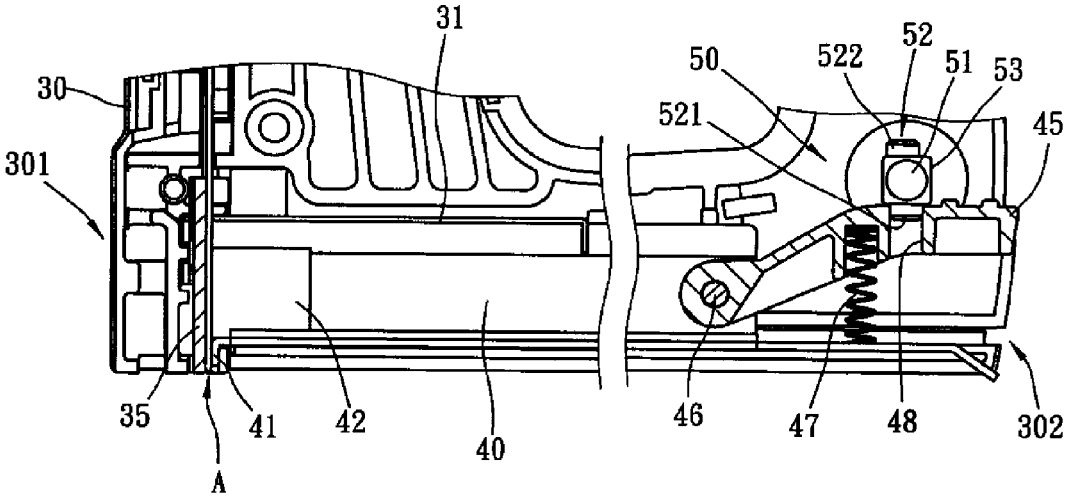
FIG. 7 is a cross-sectional view illustrating the operation of the stapling device of the first embodiment of the present invention with staples of small wire gauge.
Figure 8:
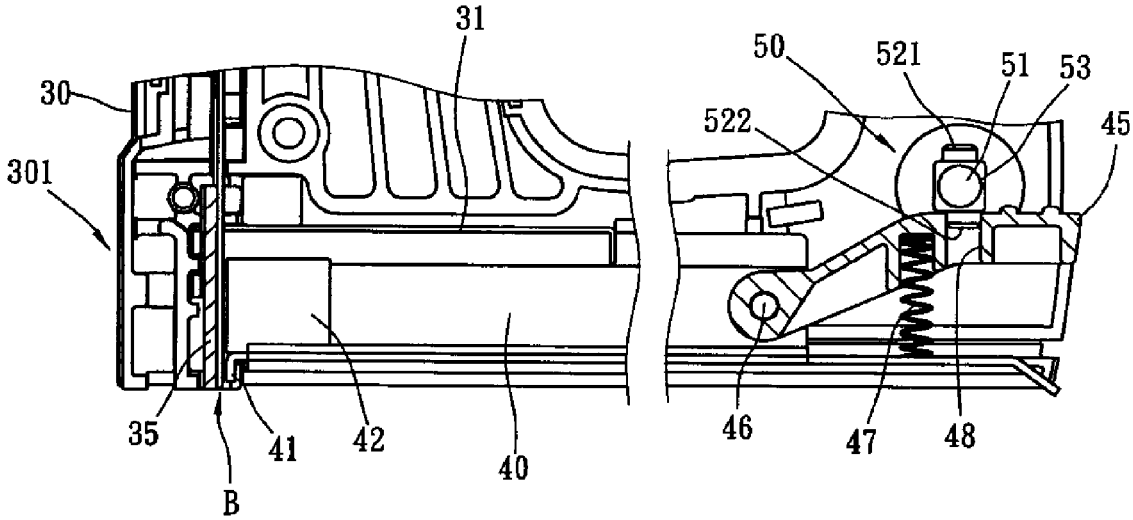
FIG. 8 is a cross-sectional view illustrating the operation of the stapling device of the first embodiment of the present invention with staples of large wire gauge.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The present invention provides a stapling device that has a staple ejection opening of which the width is adjustable in a safe, stable, convenient, and part-loss-free manner.

Referring to FIGS. 4-8, the stapling device of the present invention is comprised of a casing 30, a staple magazine 40, and an adjustor 50. The staple magazine 40 is slidably fit into a lower portion of the casing 30 and the adjustor 50 is mounted to the casing 30 for adjusting the position setting of the staple magazine 40.

The casing 30 is formed by mating two casing members and has opposite end portions respectively forming a staple ejection portion 301 and a magazine access portion 302. The staple ejection portion 301 movably receives therein a staple striker plate. The magazine access portion 302 functions to slidably receive the staple magazine 40 therein and to set the position of the staple magazine 40. The casing 30 has a lower portion forming a hollow, U-shaped receiving seat 31. A front guide plate 35 is arranged in the staple ejection portion 301. The magazine access portion 302 has opposite side walls respectively forming shaft holders 321, 322 for mounting the adjustor 50.

The staple magazine 40 has a front end forming a rear guide plate 41 that extends downward therefrom. A staple pusher 42 is slidably mounted atop the staple magazine 40. A depress-to-fix member 45 is rotatably mounted to a rear end of the staple magazine 40 by means of a pivot pin 46 to correspond to the adjustor 50. A resilient element 47 is arranged between a rear end of the depress-to-fix member 45 and an inner bottom face of the staple magazine 40 to provide a biasing force that biases the depress-to-fix member 45 upward. The depress-to-fix member 45 forms a fitting slot 48 for selective engagement with the adjustor 50.

The adjustor 50 comprises a rotatable shaft 51 that is rotatably supported by the shaft holders 321, 322. The shaft 51 comprises a fitting portion 52 that forms at least two fitting blocks 521, 522 for individually and selectively fitting into and thus engaging the fitting slot 48. The two fitting blocks 521, 522 each have an engaging face that is distant from a central axis of the shaft 51 by a different distance for respectively setting the rear guide plate 41 at different positions and thus allowing the rear guide plate 41 and the front guide plate 35 to selectively form first and second staple outlet openings A, B of different opening sizes (see FIGS. 7 and 8). Opposite ends of the shaft 51 form a polygonal rotation stop block 53 and an operation portion 55 that is also polygonal. The rotation stop block 53 and the operation portion 55 are made polygonal to correspond to the number of the fitting blocks 521, 522. The shaft holders 321, 322 respectively form a rotation stop slot 33 and a position-setting slot 34 corresponding to and mating the rotation stop block 53 and the operation portion 55 respectively for selectively cooperating with the fitting blocks 521, 522 to effect position setting by engagement of the fitting blocks with the fitting slot. The shaft 51 forms a stop 54 opposing a wall of the casing 30 and is biased by a restoration resilient element 56, whereby when the rotation stop block 53 and the operation portion 55 are moved to disengage from the rotation stop slot 33 and the position-setting slot 34, the restoration resilient element 56 generates a spring force that tends to restore the original position and with such a position-restoration spring force, the shaft 51 is normally maintained in a such a position where the rotation stop block 53 and the operation portion 55 stay in mating engagement with the rotation stop slot 33 and the position-setting slot 34 respectively. Thus, the adjustor 50 can be properly fixed inside the casing 30 without undesired rotation.

As shown in FIGS. 5-8, the operation of the present invention is that one of the fitting blocks of the shaft 51, for example the fitting block 521, which corresponds to a gauge number of the staple loaded or to be loaded in the stapling device, is set opposing downward, whereby when the staple magazine 40 is slidably pushed into the receiving seat 31, the depress-to-fix member 45 is depressed down to allow the staple magazine 40 to move to a desired position to be set and then the depress-to-fix member 45 is released and is allowed to automatically return upward to have the fitting slot 48 thereof engage the fitting block 521 by which the position of the staple magazine 40 is set. In this way, the rear guide plate 41 and the front guide plate 35 form therebetween a first staple outlet opening A (see FIG. 7) that is for staples of a first (and perhaps small) wire gauge and the stapling device is thus applicable for staples of the first gauge.

To operate with staples of a second (and perhaps great) gauge, the depress-to-fix member 45 is depressed down again to disengage the fitting slot 48 from the fitting block 521 and now the adjustor 50 is moved axially along the shaft 51 by manually and outward pulling the operation portion 55. The rotation stop block 53 and the operation portion 55 are moved out of engagement with the rotation stop slot 33 and the position-setting slot 34 so as to allow the rotation of the shaft 51 to set the other fitting block 522 to face downward. Releasing the shaft 51 then allows the shaft 51 to return to the original axial position by the spring force of the restoration resilient element 56 and the rotation stop block 53 and the operation portion 55 are once against set in engagement with the rotation stop slot 33 and the position-setting slot 34. At this time, releasing the depress-to-fix member 45 allows the depress-to-fix member 45 to automatically return upward, making the fitting slot 48 engaging the other fitting block 522. Due to the distance of the fitting block 522 with respect to the central axis of the shaft 51, the staple magazine 40 is now slightly backward retracted and set in a new position where the rear guide plate 41 and the front guide plate 35 form therebetween a second staple outlet opening B (see FIG. 8) that is for staples of a second (and perhaps great) wire gauge and the stapling device is thus applicable for staples of the second and large gauge.

The present invention provide a stapling device that uses an adjustor 50 arranged in the magazine access portion 302 to adjust the gap size or width of the staple outlet opening. Since no part that is subjected to high speed movement or great magnitude of operating force, the structure for the adjustment of the gap size can be made relatively stable. Thus, as compared to the conventional structures for adjusting the gap size, the present invention offers the efficacy of being sound and stable, thereby substantially improving operation safety. Further, for the structure for adjusting gap size of staple outlet opening in accordance with the present invention, since it is integrated with the casing 30 of a stapling device and requires no loosening of part in operation thereof, there will be no worry about loss or undesired detachment of parts. And, adjustment of gap size of staple outlet opening can be easily realized through pulling and rotating the adjustor 50. This further enhances the convenience of operation.

Figure 9:
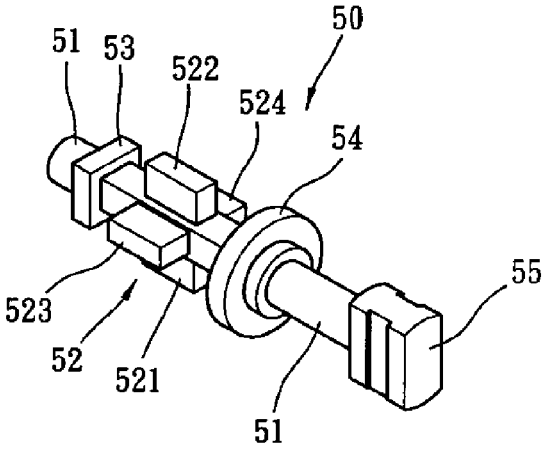
FIG. 9 is a perspective view illustrating an adjustor for a stapling device constructed in accordance with a second embodiment of the present invention.
Figure 10:
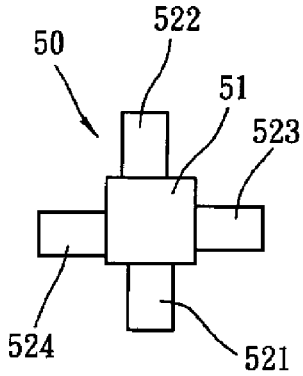
FIG. 10 is a cross-sectional view of the adjustor of the stapling device of the second embodiment of the present invention.
Figure 11:
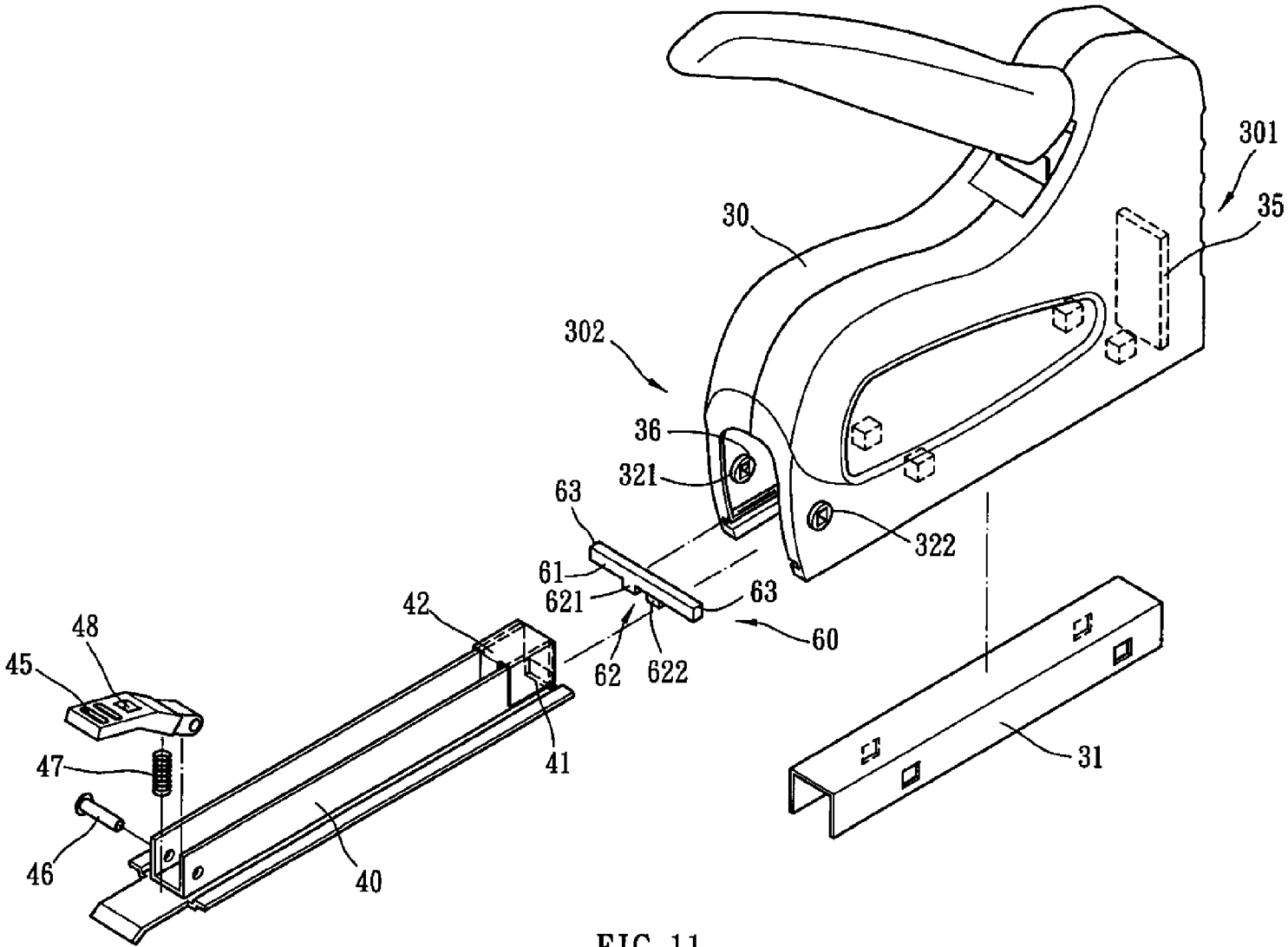
FIG. 11 is an exploded view of a stapling device constructed in accordance with a third embodiment of the present invention.
Figure 12:
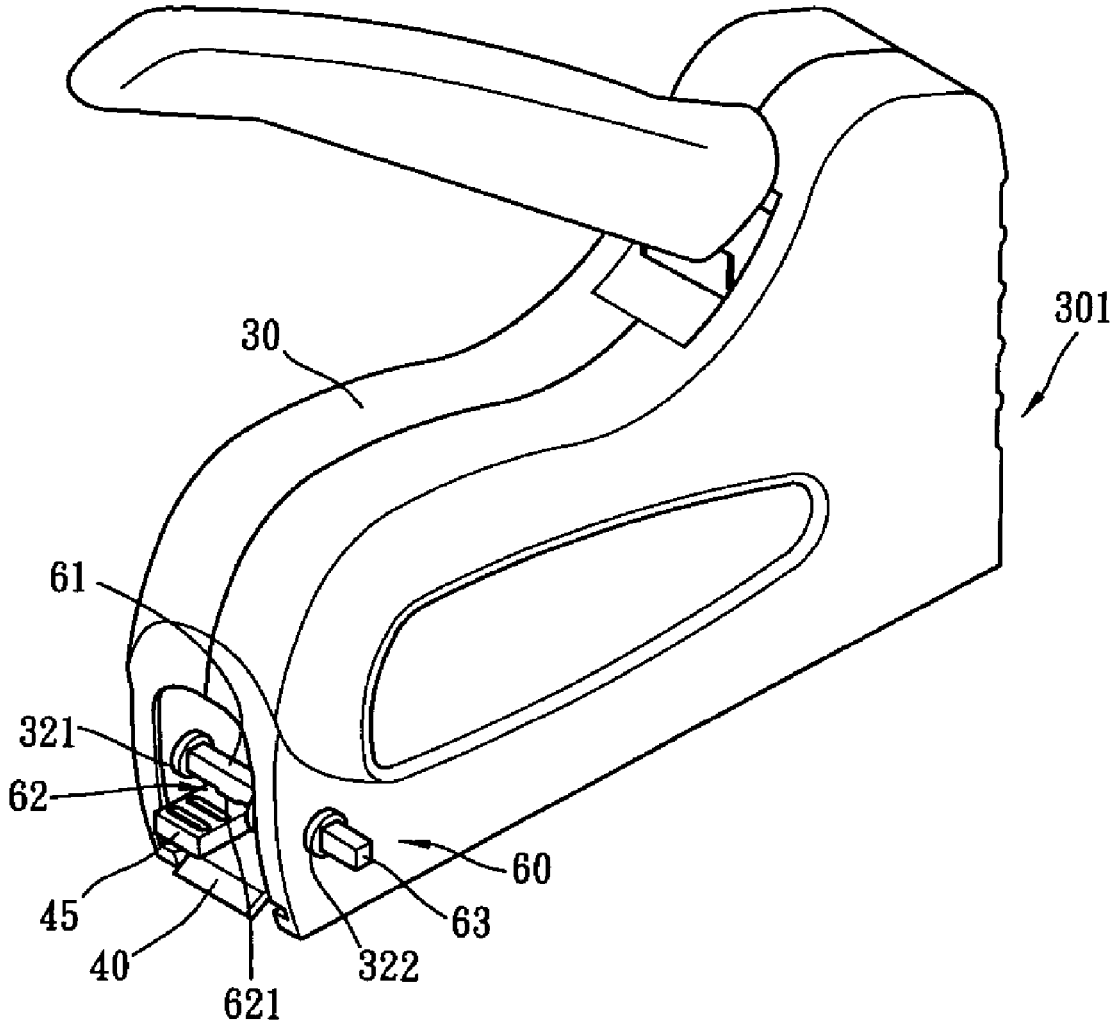
FIG. 12 is a perspective view of the stapling device of the third embodiment of the present invention.
Figure 13:
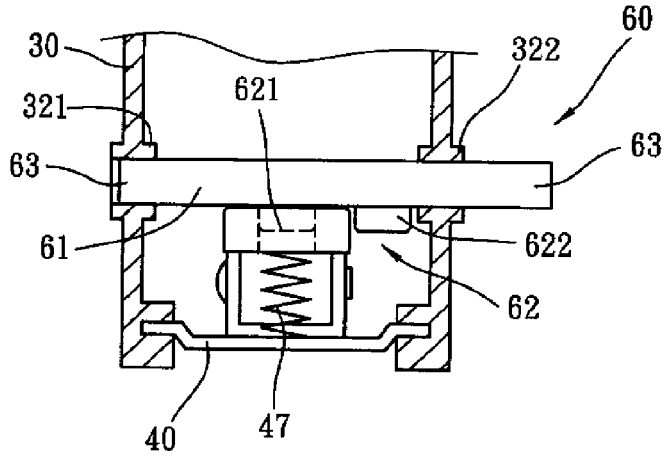
FIG. 13 is a cross-sectional view of the stapling device of the third embodiment of the present invention, observed from the rear side.
Figure 14:
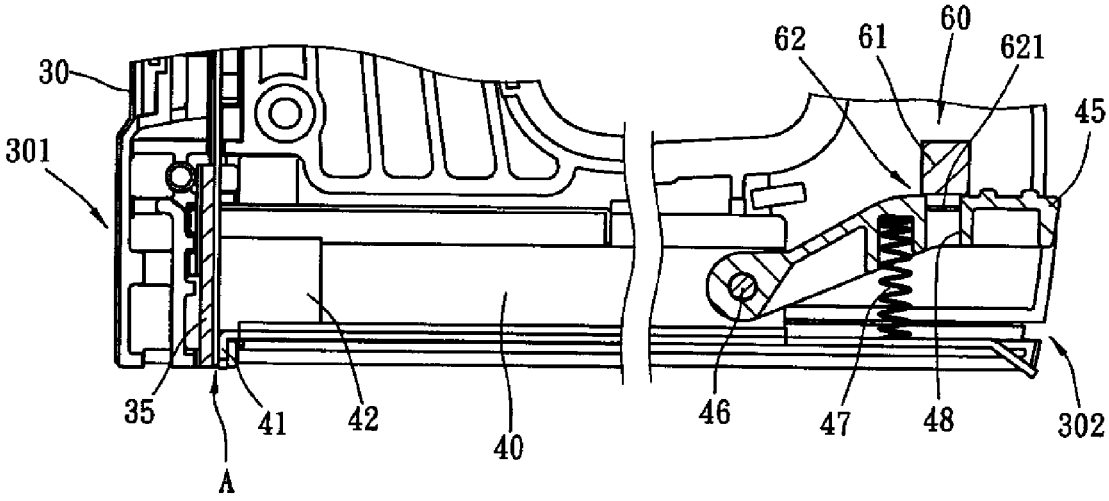
FIG. 14 is a cross-sectional view illustrating the operation of the stapling device of the third embodiment of the present invention with staples of small wire gauge.
Figure 15:
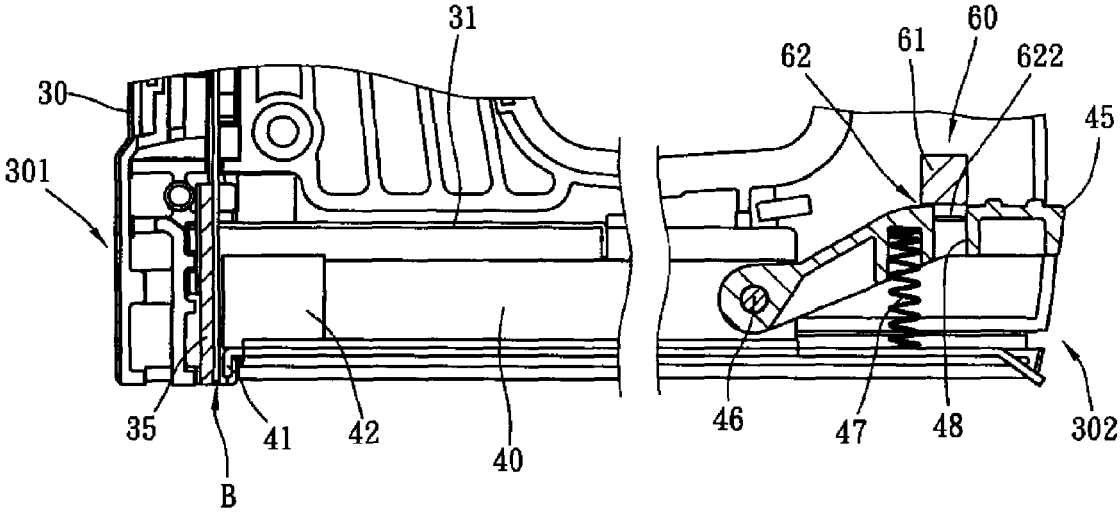
FIG. 15 is a cross-sectional view illustrating the operation of the stapling device of the third embodiment of the present invention with staples of large wire gauge.

As shown in FIGS. 9 and 10, the adjustor 50 can alternatively be structured by forming four fitting blocks 521, 522, 523, 524 that are selectively fit into and engageable with the fitting slot 48. The four fitting blocks 521, 522, 523, 524 each have an engaging face that is distant from the central axis of the shaft 51 by a different distance, as shown in FIG. 10, to increase the number of selectable setting positions for the staple magazine 40, where the rear guide plate 41 and the front guide plate 35 forms therebetween a staple outlet opening of different width or gap size. This allows the stapling device to be applicable to staples of further different gauges.

Figure 16:
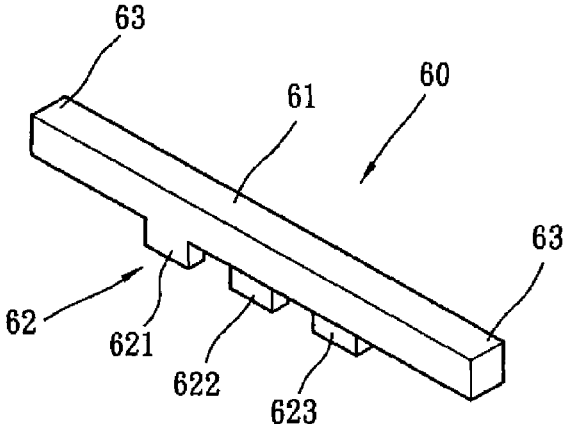
FIG. 16 is a perspective view illustrating an adjustor for a stapling device constructed in accordance with a fourth embodiment of the present invention.
Figure 17:
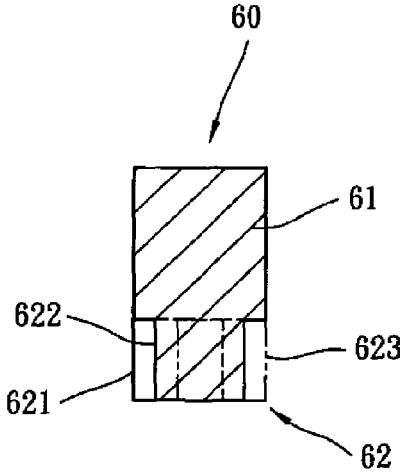
FIG. 17 is a cross-sectional view of the adjustor of the stapling device of the fourth embodiment of the present invention.

As shown in FIGS. 11-15, a different embodiment is given, wherein the adjustor 60 comprises a transversely-extending shaft 61 that is linearly movable or slidable in the transverse direction. The shaft 61 comprises a fitting portion 62 that forms at least two fitting blocks 621, 622 spaced in the transverse direction on a bottom of the shaft 61. The two fitting blocks 621, 622 have engaging faces that are distant from a central axis of the shaft 61 by different distances so as to make the rear guide plate 41 and the front guide plate 35 selectively forming first and second staple outlet openings A, B of different opening sizes (see FIGS. 14 and 15). Opposite ends of the shaft 61 form push sections 63 that transversely project out of the casing 30. As shown in FIGS. 16 and 17, the adjustor 60 can alternatively be structured by forming three fitting blocks 621, 622, 623, which have engaging faces that are distant from the central axis of the shaft 61 by different distances, as shown in FIG. 17, so as to selectively make the rear guide plate 41 and the front guide plate 35 forming therebetween a staple outlet opening of different width or gap size. This allows the stapling device to be applicable to staples of further different gauges.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A stapling device, comprising:

a casing, which has opposite end portions respectively forming a staple ejection portion and a magazine access portion, the staple ejection portion movably receiving therein a staple striker plate that is operable to effect powerful striking, the casing having a lower portion forming a receiving seat, a front guide plate being arranged in the staple ejection portion of the casing for; guiding the staple striker plate;

a staple magazine, which is slidably received in the receiving seat of the casing and has a front end forming a rear guide plate that extends downward therefrom and forms a predetermined spacing from the front guide plate, a staple pusher being slidably mounted to the staple magazine for driving staples forward, a depress-to-fix member being mounted to a rear end of the staple magazine and automatically movable upward for position returning, the depress-to-fix member forming a fitting slot; and an adjustor, which is mounted to the magazine access portion of the casing to correspond to the depress-to-fix member of the staple magazine, the adjustor comprises a fitting portion that is selectively engageable with the depress-to-fix member, the fitting portion forming at least two fitting blocks for individually and selectively fitting into and thus engaging the fitting slot, the two fitting blocks each having an engaging face that is distant from a central axis of the adjustor by a different distance.

2. The stapling device according to claim 1, wherein the depress-to-fix member of the staple magazine is rotatably mounted by a pivot pin and wherein a resilient element is arranged between a rear end of the depress-to-fix member and an inner bottom face of the staple magazine to provide a biasing force therebetween.

3. The stapling device according to claim 1, wherein the adjustor comprises a shaft rotatably mounted to the casing, the fitting blocks of the fitting portion being formed along a circumference of the shaft.

4. The stapling device according to claim 3, wherein the casing forms shaft holders on opposite walls of the magazine access portion for rotatably supporting the shaft, the shaft forming at opposite ends thereof a rotation stop block and an operation portion both being made polygonal to correspond to number of the fitting blocks, the shaft holders respectively forming a rotation stop slot and a position-setting slot corresponding to and mating the rotation stop block and the operation portion respectively.

5. The stapling device according to claim 4, wherein the shaft of the adjustor forms a stop opposing a wall of the casing for supporting a restoration resilient element that generates a position-restoration spring force.

6. The stapling device according to claim 4, wherein the fitting portion of the adjustor comprises four fitting blocks circumferentially arranged on the shaft.

7. The stapling device according to claim 3, wherein the shaft of the adjustor forms a stop opposing a wall of the casing for supporting a restoration resilient element that generates a position-restoration spring force.

8. The stapling device according to claim 3, wherein the fitting portion of the adjustor comprises four fitting blocks circumferentially arranged on the shaft.

9. The stapling device according to claim 1, wherein the fitting portion of the adjustor comprises four fitting blocks circumferentially arranged on the shaft.

10. The stapling device according to claim 1, wherein the adjustor comprises a shaft slidably mounted to the casing, the fitting blocks of the fitting portion being formed on a bottom of the shaft and spaced along the shaft.

11. The stapling device according to claim 10, wherein the shaft has opposite ends forming push sections that project out of the casing.

12. A stapling device, comprising:

a casing, which has opposite end portions respectively forming a staple ejection portion and a magazine access portion, the staple ejection portion movably receiving therein a staple striker plate that is operable to effect powerful striking, the casing having a lower portion forming a receiving seat, a front guide plate being arranged in the staple ejection portion of the casing for; guiding the staple striker plate;

a staple magazine, which is slidably received in the receiving seat of the casing and has a front end forming a rear guide plate that extends downward therefrom and forms a predetermined spacing from the front guide plate, a staple pusher being slidably mounted to the staple magazine for driving staples forward, a depress-to-fix member being mounted to a rear end of the staple magazine and automatically movable upward for position returning, the depress-to-fix member forming a fitting slot; and an adjustor, which is mounted to the magazine access portion of the casing to correspond to the depress-to-fix member of the staple magazine, the adjustor comprises a shaft that is rotatably mounted to the casing, the shaft forming a fitting portion that is selectively engageable with the depress-to-fix member, the fitting portion forming at least two fitting blocks along a circumference of the shaft for individually and selectively fitting into and thus engaging the fitting slot, the fitting blocks each having an engaging face that is distant from a central axis of the adjustor by a different distance.

13. The stapling device according to claim 12, wherein the fitting portion comprises four fitting blocks.

14. The stapling device according to claim 13, wherein the shaft forms at opposite ends thereof a rotation stop block and an operation portion, both being made polygonal to correspond to number of the fitting blocks, the casing forming shaft holders on opposite walls of the magazine access portion for rotatably supporting the shaft, the shaft holders respectively forming a rotation stop slot and a position-setting slot corresponding to and mating the rotation stop block and the operation portion respectively.

15. The stapling device according to claim 13, wherein the shaft of the adjustor forms a stop opposing a wall of the casing for supporting a restoration resilient element that generates a position-restoration spring force.

16. The stapling device according to claim 12, wherein the shaft forms at opposite ends thereof a rotation stop block and an operation portion, both being made polygonal to correspond to number of the fitting blocks, the casing forming shaft holders on opposite walls of the magazine access portion for rotatably supporting the shaft, the shaft holders respectively forming a rotation stop slot and a position-setting slot corresponding to and mating the rotation stop block and the operation portion respectively.

17. The stapling device according to claim 12, wherein the shaft of the adjustor forms a stop opposing a wall of the casing for supporting a restoration resilient element that generates a position-restoration spring force.

18. The stapling device according to claim 12, wherein the depress-to-fix member of the staple magazine is rotatably mounted by a pivot pin and wherein a resilient element is arranged between a rear end of the depress-to-fix member and an inner bottom face of the staple magazine to provide a biasing force therebetween.

19. A stapling device, comprising:

a casing, which has opposite end portions respectively forming a staple ejection portion and a magazine access portion, the staple ejection portion movably receiving therein a staple striker plate that is operable to effect powerful striking, the casing having a lower portion forming a receiving seat, a front guide plate being arranged in the staple ejection portion of the casing for guiding the staple striker plate;

a staple magazine, which is slidably received in the receiving seat of the casing and has a front end forming a rear guide plate that extends downward therefrom and forms a predetermined spacing from the front guide plate, a staple pusher being slidably mounted to the staple magazine for driving staples forward, a depress-to-fix member being mounted to a rear end of the staple magazine and automatically movable upward for position returning, the depress-to-fix member forming a fitting slot; and an adjustor, which is mounted to the magazine access portion of the casing to correspond to the depress-to-fix member of the staple magazine, the adjustor comprises a shaft that is slidably mounted to the casing, the shaft forming a fitting portion that is selectively engageable with the depress-to-fix member, the fitting portion forming at least two fitting blocks on a bottom of the shaft and spaced along the shaft for individually and selectively fitting into and thus engaging the fitting slot, the fitting blocks each having an engaging face that is distant from a central axis of the adjustor by a different distance.

20. The stapling device according to claim 19, wherein the fitting portion comprises three fitting blocks.

21. The stapling device according to claim 20, wherein the shaft has opposite ends forming push sections that project out of the casing.

22. The stapling device according to claim 19, wherein the shaft has opposite ends forming push sections that project out of the casing.

23. The stapling device according to claim 19, wherein the depress-to-fix member of the staple magazine is rotatably mounted by a pivot pin and wherein a resilient element is arranged between a rear end of the depress-to-fix member and an inner bottom face of the staple magazine to provide a biasing force therebetween.

* * * * *